US005389027A

United States Patent [19]

Kantor et al.

[11] Patent Number: 5,389,027

[45] Date of Patent: Feb. 14, 1995

[54] COLLECTOR'S MODEL DISINTEGRATOR PISTOL (CMDP)

[76] Inventors: Ellis Kantor, Ektek 975 Hornet Dr., Ste. 210, Hazelwood, Mo. 63042; Daniel H. Heymann, HCO Services, 12921 Nimes Dr., St. Louis, Mo. 63141

[21] Appl. No.: 144,244

[22] Filed: Nov. 1, 1993

[51] Int. Cl.[6] ..... A63H 17/045; A63H 3/31; A63H 5/04; A63H 33/30

[52] U.S. Cl. ..... 446/23; 446/192; 446/405; 446/473

[58] Field of Search ..... 446/23, 473, 22, 192, 446/188, 181, 180, 176, 397, 401, 405, 406; 431/273

[56] References Cited

U.S. PATENT DOCUMENTS

| | | | |
|---|---|---|---|
| 580,967 | 4/1897 | Whitaker | 446/405 |
| 1,358,722 | 11/1920 | Fuller | 446/23 X |
| 1,779,892 | 10/1930 | Roe | 446/188 X |
| 2,055,900 | 9/1936 | LeFever | 446/192 |
| 2,336,391 | 12/1943 | Burchett | 446/23 |
| 2,440,177 | 4/1948 | Laidig | 446/23 |
| 2,729,208 | 1/1956 | Gaeke | 446/192 X |
| 2,783,588 | 3/1957 | Charvat | 446/473 X |
| 3,078,618 | 2/1963 | Hough et al. | 446/192 |
| 3,391,486 | 7/1968 | Butler et al. | 446/192 |
| 3,709,655 | 1/1973 | Beijering | 431/276 |

*Primary Examiner*—Robert A. Hafer
*Assistant Examiner*—D. Neal Muir
*Attorney, Agent, or Firm*—Henry W. Cummings

[57] ABSTRACT

In accordance with the present invention, a Collector's Model Disintegrator Pistol (CMDP) is formed from a pair of right side and left side metal castings according to the investment or "lost wax" casting process. Preferably the left and right hand pistol sections are formed of suitable ornamental bronze, with a wide variety of possible bronze compositions being usable, depending upon cost and desirability of a particular finish. The bronze left and right sections are held together with counter sunk-screws instead of the crimped projections according to the construction made of U.S. Pat. No. 2,077,763. Additionally the U-shaped guide assembly of the '763 patent is eliminated and a trigger guide assembly is contoured into the cast left and right sections of the pistol to make construction simpler and less expensive.

19 Claims, 8 Drawing Sheets

COLLECTOR'S MODEL DISINTEGRATOR PISTOL (CMDP)

BACKGROUND OF THE INVENTION

U.S. Pat. No. 2,077,763 discloses a toy gun formed of two complimentary metal stampings held together with five crimped outwardly extending projections.

The metal stampings together define a handle portion, a body portion including a slot for activating a trigger, and an outwardly extending barrel portion housing an air cylinder and a pop mechanism.

Located between the metal stampings is a generally U-shaped guide assembly for a trigger assembly for operating the pop mechanism.

However, the design described in U.S. Pat. No. 2,077,763 has the disadvantage that the metal stampings do not have a classical or collector's item external appearance.

The toy guns according to U.S. Pat. No. 2,077,763 were made with a construction whereby the metal stampings were held together with five crimped projections. These projections do not make a classical or collector's item appearance. Furthermore, the crimped projections are less rugged.

The U-shaped guide trigger assembly described in the U.S. Pat. No. 2,077,763 is an expensive member and makes fabrication of the assembly according to the '763 patent unnecessarily complicated and expensive.

SUMMARY OF THE INVENTION

A) Objects of the Invention

One object of the present invention is to provide a Collector's Model Disintegrator Pistol (CMDP) which is made of a material which gives a classical, collector's item external appearance.

Another object of the present invention is to provide a method of forming the CMDP with an external appearance of a classical, collector's item.

Another object of the present invention is to provide an improved arrangement for holding the two halves of the pistol assembly together.

Another object of the present invention is to reduce the cost of manufacture of the internal parts of the CMDP by eliminating the guide assembly for the trigger described in U.S. Pat. No. 2,077,763.

Other objects will be apparent from the description and drawings provided herein after.

B) Summary

In accordance with the present invention the foregoing objects are achieved by forming the CMDP from a pair of right side and left side metal castings formed according to the "lost wax" or investment casting process. Preferably the left and right hand pistol sections are formed of suitable bronze with a wide variety of possible bronze compositions being usable, depending upon cost and desirability of a particular finish.

The bronze left and right sections are held together with counter sunk-screws instead of the crimped projections according to the construction made of the '763 patent.

Additionally the U-shaped guide assembly of the '763 patent is eliminated and a trigger guide assembly is contoured into the cast left and right sections of the CMDP.

THE DRAWINGS

DESCRIPTION OF PREFERRED EMBODIMENTS

Figure 1:
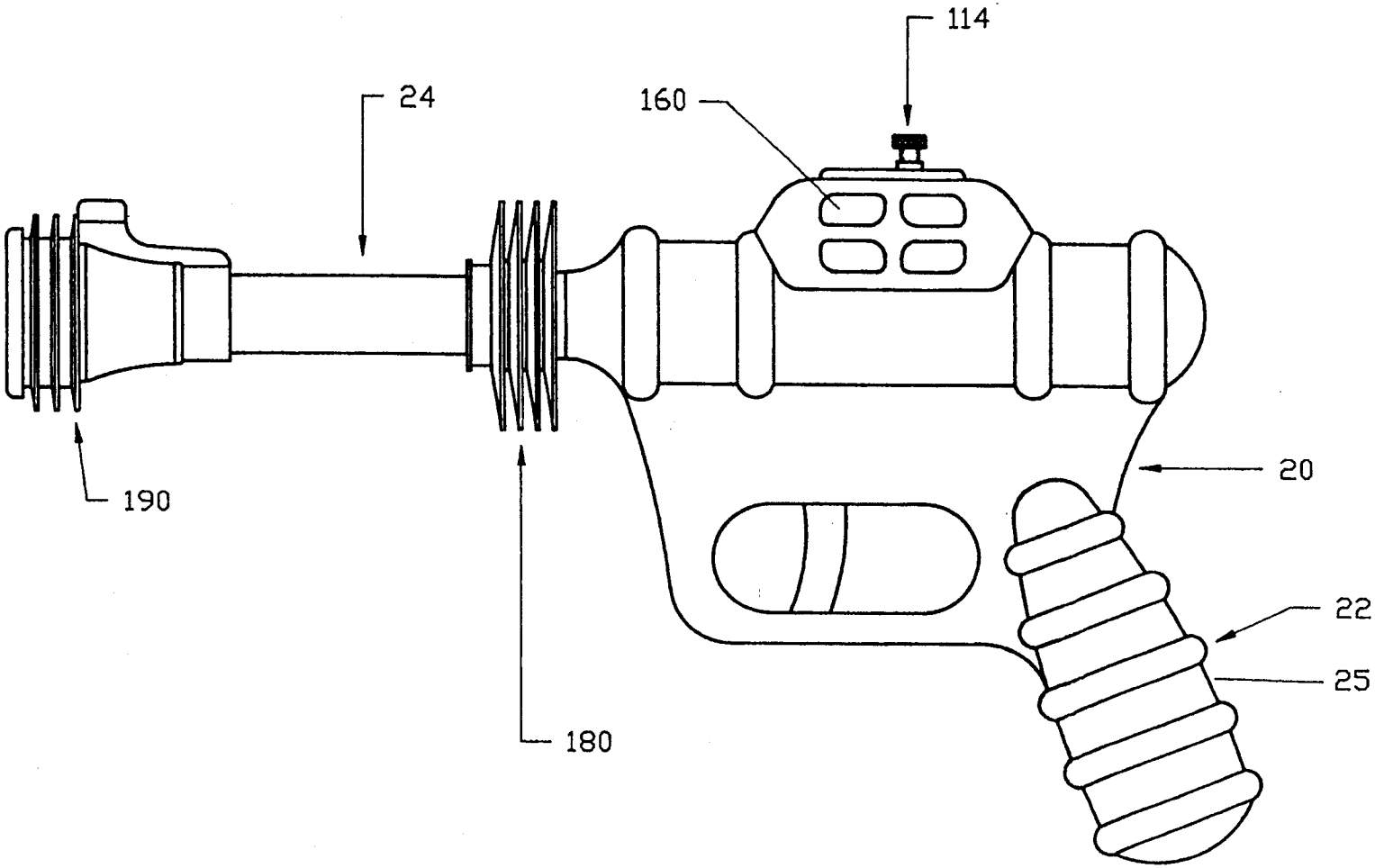
FIG. 1 is a side elevation view partly in sections of the CMDP of the present invention.
Figure 2:
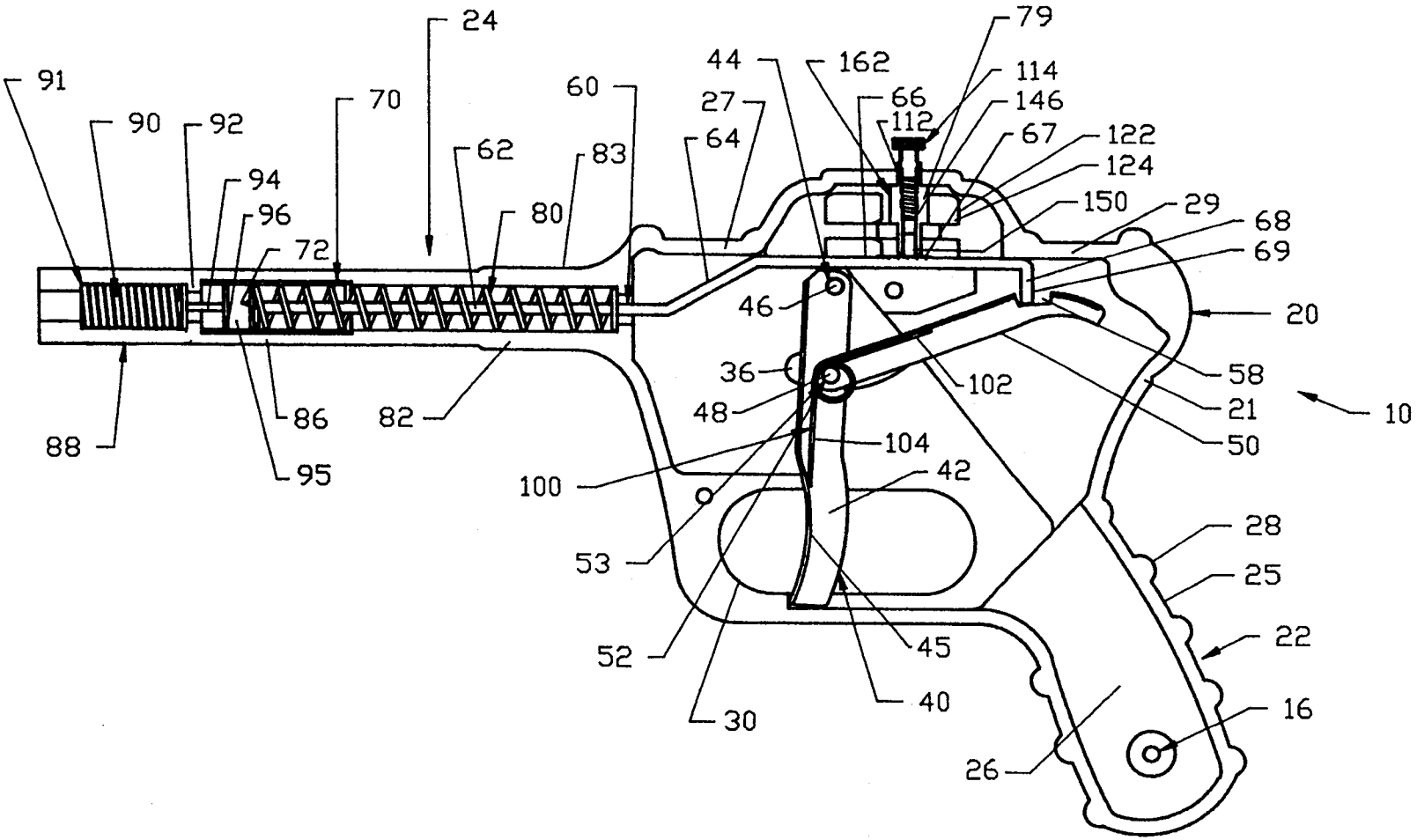
FIG. 2 is a side elevation view of the pistol of the present invention.
Figure 3:
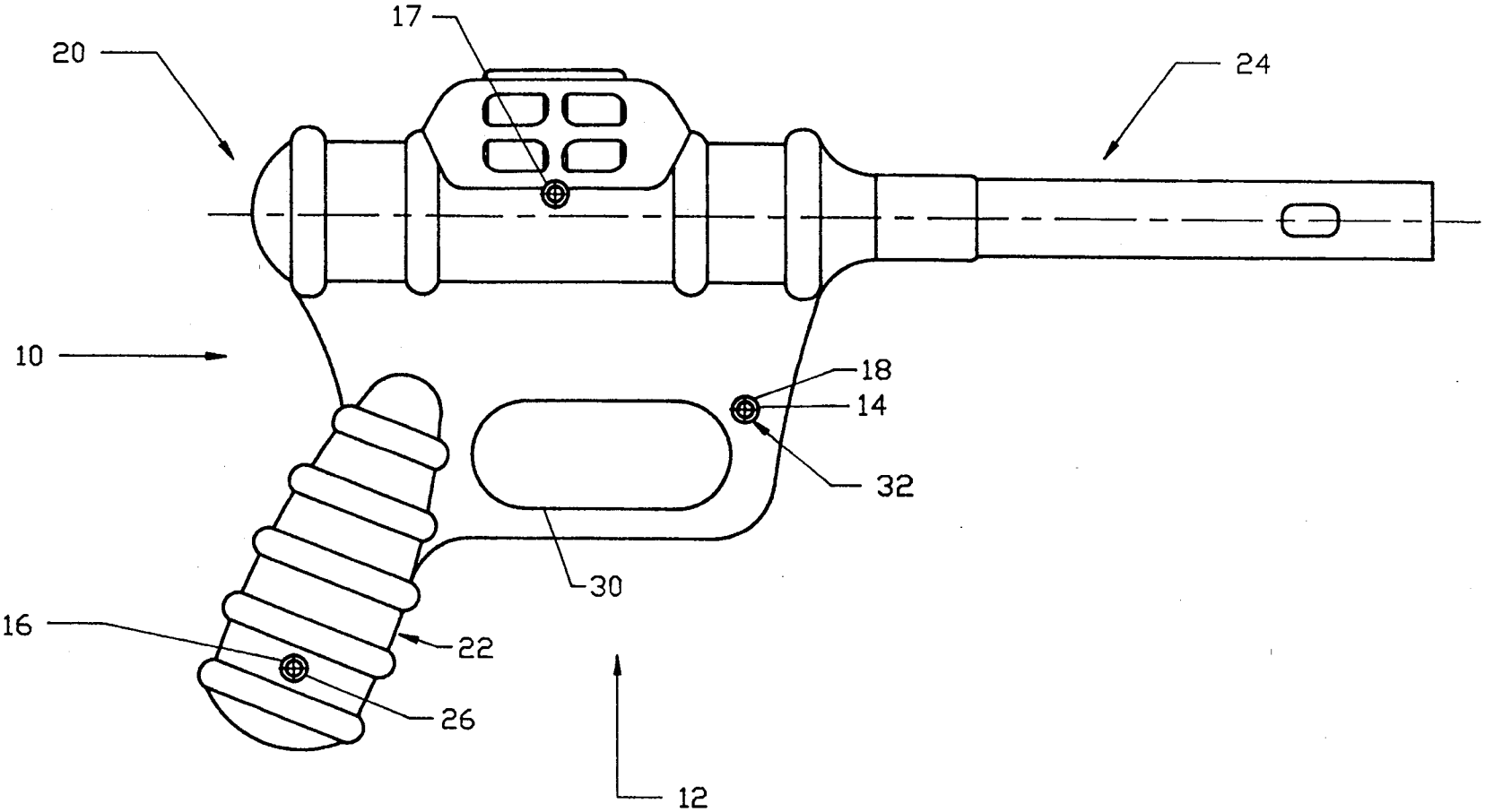
FIG. 3 is a side elevation view of a second half of the pistol of the present invention.

The Collector's Model Disintegrator Pistol (CMDP) is indicated in the drawing Marked FIG. 1 through FIG. 10. The pistol includes a body portion (20), a handle portion (22) and a barrel portion (24). (FIG. 3).

Figure 4:
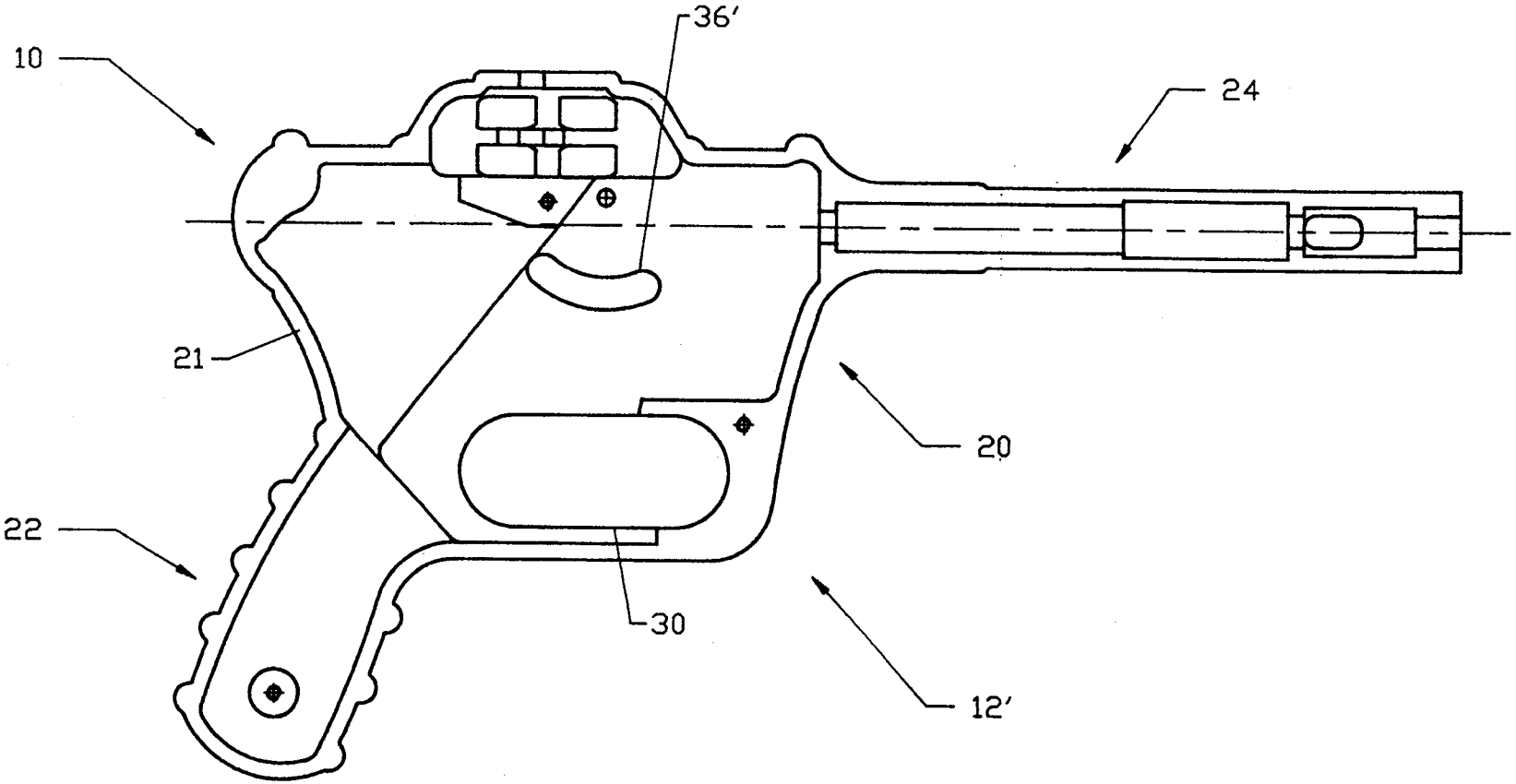
FIG. 4 is a side elevation view partly in sections of the pistol of the present invention.

The handle portion (22), body portion (20), and barrel portion (24) are formed from a pair of cast members formed from the "lost wax" or investment casting process and indicated in the drawings at 12 and 12' respectively, being the right and left members and mirror images of each other. Bronze or other alloys may be used, such as alloys C80100–C87400 of the 1990 MATERIALS SELECTOR, pp. 100–101. (FIGS. 3 & 4).

The "lost wax" or investment casting process is a very old, well known casting process for making difficult to form shapes and avoid expensive machining. For example, see A. J. Clegg, *Precision Casting Processes,* Pergamon Press, Oxford, N.Y., pp. 145–173, Copyright 1991; Heine, et al., *Principles of Metal Casting,* 2nd Ed. Copyright 1967, McGraw Hill, pp. 36–41; *Metals Handbooks* 8th Ed., Vol. 5, pp. 237–261, 9th Ed. pp. 253–269; *Lost Wax Process of Casting Jewelry,* Keith Edwards, Copyright 1985, Henry Regnery Co. The process involves production of an expendable (usually wax) pattern. This pattern is a precise component produced from a precision-engineered die. Complex features may be obtained in the pattern by the use of multi-part dies or by the use of soluble wax cores or permanent ceramic cores. The wax patterns are assembled with the gating and feeding system and cleaned prior to their investment with the ceramic coating. This ceramic coating is built up through successive stages of dipping and stuccoing. The initial (primary) dip coat, containing a fine refractory, is allowed to gel before the assembly is dipped in a secondary dip tank and stuccoed with coarser, dry particles in a raining cabinet or fluidized bed. Following gelation of the binder this procedure is repeated until the required shell thickness is obtained. On completion of the gelation stage the expendable wax pattern is removed, preferably in a steam autoclave, and the ceramic shell fired to around 1000 degrees Celsius prior to casting. Pistol halves 12, 12' are so cast.

The right and left cast sections (12, 12') are held together with brass screws (14) extending from one member to the other through openings at 16, 17, and 18. The openings are counter sunk on one end and threaded on the other to achieve an effective fastening arrangement which has a good external appearance. The composition and color of the brass screws preferably matches the composition and color of the bronze casting halves.

The handle portion (22) includes cast projections (28) which extend from wall portion (25) formed in each of the left and right halves. The handle portion is hollow as indicated at 26.

The pistol body portion (20) includes a wall portion (21) again formed from the cooperating left and right cast pistol halves and includes a cast trigger opening (30) and cam slot (36, 36') cast into each of the respective cast halves (12, 12'). (FIGS. 2 & 4).

A trigger member (40) is pivotally mounted at 44 upon a transversely extending pin (46). The trigger (40) is channel shaped and includes an arcuate distal end portion (42) for grasping by a finger of the operator. The pin (44) may be threaded into a drilled opening in either or both of the half members (12, 12'). (FIG. 2).

A link (50) is also channel shaped and is pivotally mounted upon the trigger (40) by means of a dowel pin (52) extending through the opening (53) at one end, and includes a slot (58) near its distal end.

The pin (52) (FIG. 2) moves through opening (48) in trigger (40) within the slot (36, 36') (FIG. 4) formed in the interior of the left and right members by the casting process. (FIG. 2 & FIG. 4).

A lever spring (100) includes a first leg (102) connected to link (50) and a depending leg (104) adopted to engage the surface (45) of trigger member (40). Spring (100) biases link (50) and trigger (40) into the forward position shown in FIG. 1. (FIG. 2 also).

A piston rod (60) includes a rod portion (62) which extends within a coil spring (80), an inclined portion (64) within body portion (20), a horizontal portion (66) having a cut or rough area (67), and a distal end portion (68) having a downward extension (69) extending into the slot (58). Piston rod (68) may be a stamped or punched metal pan. (FIG. 2).

It is to be noted that piston rod (60) engages inner body wall portions (27 and 29) during its back and forth movement through the body portion (20). (FIG. 2).

Piston rod portion (62) extends within a coil spring (80) located in the barrel portion (24). The barrel portion (24) includes a wall portion (82) which is hollow which receives the coil spring (80) and cylinder (70). The cylinder (70) receives a piston head (72) connected in a suitable manner to the piston rod (60) by interference fit or by mechanical fasteners. (FIG. 2).

The wall portion (82) of the barrel (24) is reduced in cross section at 86 to mount the cylinder (70) therein. (FIG. 2).

Furthermore, the cross section of the barrel portion (82) is increased at 88 to receive a spring (90). Spring (90) has a head (92) connected to a piston (94) which in turn is connected to a piston head (96) located within the cylinder (70). (FIG. 2). The space (95) is between piston heads (72) and (96).

Both coil springs (80, 90) are commercially available items. For example, spring (90) may be a CO360-051-125OM. (FIG. 2).

Figure 5:
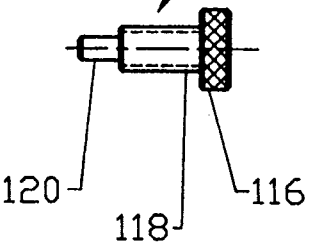
FIG. 5 is a view of the flint knob assembly of the present invention.

A spark (flint) assembly (79) includes an opening (112) in head portion (162) of body portion (20) opening (112) receives a flint knob (114) having a knurled gripping portion (116), a threaded portion (118) and a projecting non-threaded portion (120) of reduced cross section (FIG. 2 and FIG. 5).

Figure 6:
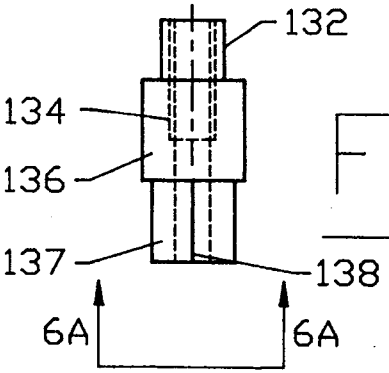
FIG. 6 is a view of the flint housing of the present invention.
Figure 6A:
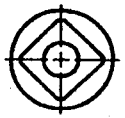
FIG. 6A is a view looking in the direction of the arrows along the line 6A—6A in FIG. 6.

A flint housing (130, FIG. 6) is mounted within a head portion (162) and includes an upward extending hollow threaded portion (132) adopted to receive projecting portion (120), threaded portion (118) of flint knob (114). Threads (134) extend into a housing body portion (136). (FIG. 6).

Figure 7:
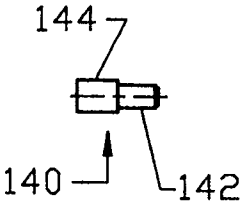
FIG. 7 is a view of the flint pusher of the present invention.
Figure 7A:
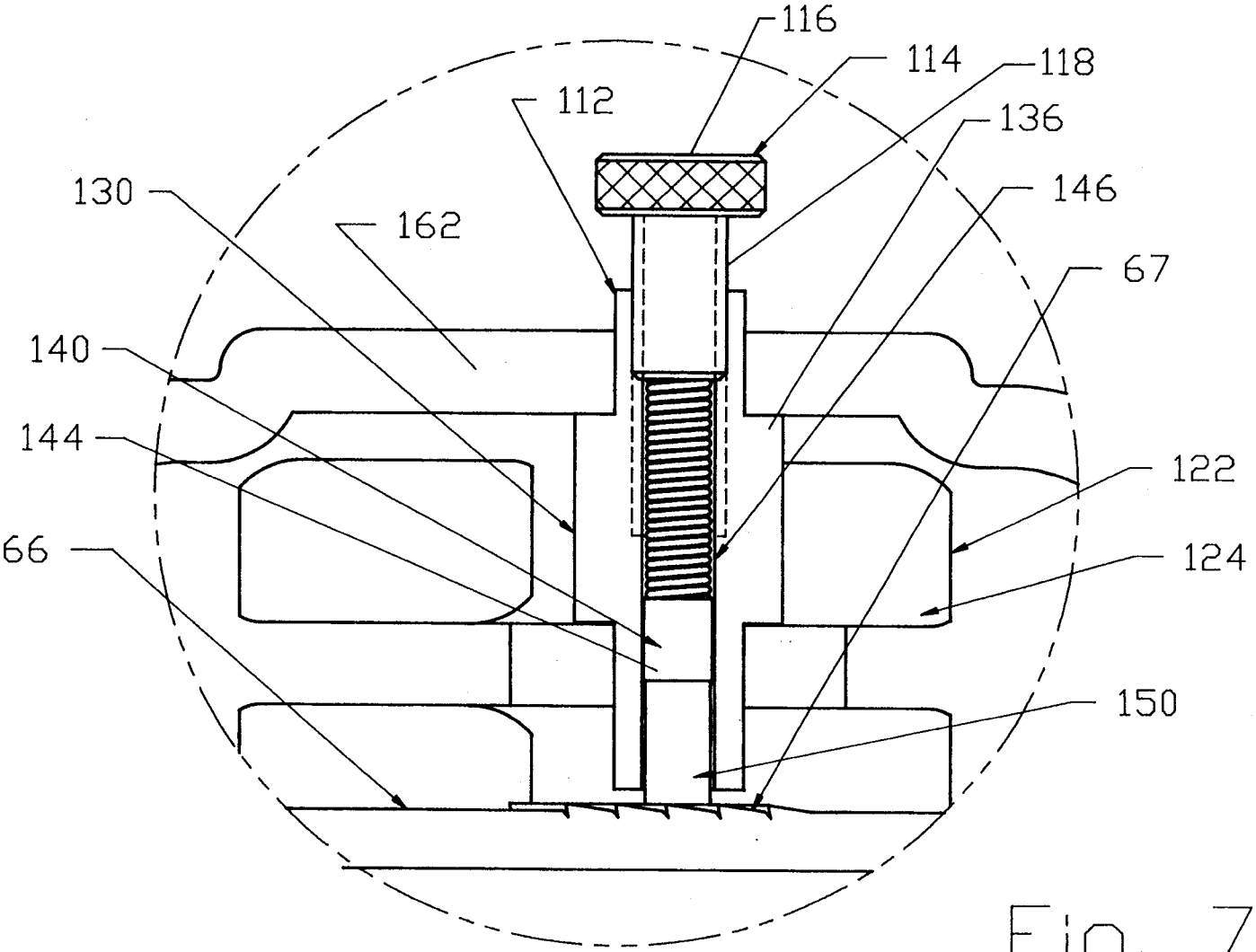
FIG. 7A is an enlarged view of a portion of FIG. 1.
Figure 9A:
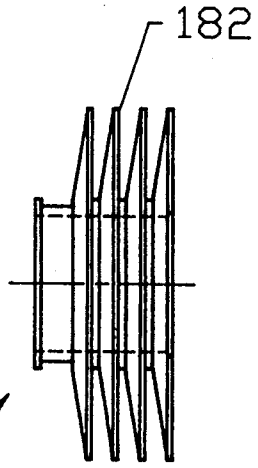
FIG. 9A is a side elevation view of a flint assembly used in the present invention.
Figure 9:
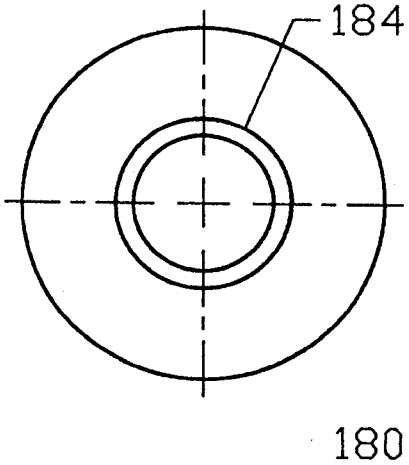
FIG. 9 is an end view of a cooling assembly utilized in the present invention.

An unthreaded downward extending portion (137) includes an opening (138). A flint pusher (140) includes a upwardly extending portion (142) adopted to extend into housing (138) and engage the lower portion of a spring (146) mounted within housing (130). Spring (146) may be purchased item C0088-012-0620M. (FIGS. 2, 6, & 7).

Spring (146) is held captive between the depending portion (120) of knob (114) and upwardly extending portion (142) of flint pusher (140). Hint pusher (140, FIG. 7) engages the flint (150) to force it into the engagement with the cut and rough portion (67) of piston rod (60) as piston rod (60) moves from right to left after spring (80) is released. (FIGS. 2, 5 & 7).

It is to be noted that the guide portion for the movement of piston rod (60) is formed by cooperating services of the cast halves (12, 12'). Thus the pin (52) moves within opposed slots (36, 36') formed in the two halves (12, 12'). Piston rod portion (66) moves along the surfaces (27, 29) of body portion (20). Thus the need for a separate guide assembly for piston rod (60) is avoided in the present invention. (FIG. 2).

Openings (160) are provided in the head portion (162). Translucent members (170) including spark lens members (172) having contoured comers (173, 174, FIG. 8) are held within the openings (160) by means of a suitable adhesive such as glue or with mechanical fasteners. Thus, when the piston rod (60) moves against the flint (150) and the spark ignites, the spark will be viewable through the translucent members (170) located in openings (160). (FIG. 2, 8).

A cooling fin assembly (180, FIGS. 9 and 9A) includes a plurality of tapered thin members (182) extending outward from a circular wall portion (184) which integrally engages the barrel portion (24) at portion (83). Cooling fin assembly (180) is conveniently made of aluminum or magnesium alloy, see 1990 MATERIALS SELECTOR pp. 78–87 and 106–109; and may be either diecast or extruded as single piece for economy of production. It may be shrunk to achieve an integral connection with barrel body portion (83) or a suitable adhesive may be used such as Lock-Tite. (FIGS. 1, 2, 9 and 9A).

A second cooling fin assembly (190) is provided (FIGS. 10 and 10B) including tapered fin members (192) extending out from a fin body portion (194). Cooling fin assembly (190) may also be made of aluminum, magnesium, or alloy and may be diecast or extruded. See MATERIALS SELECTOR supra.

The cross-sectional area of the body portion (194) becomes reduced as indicated at (196) to facilitate attachment of the cooling assembly to the portion (88) barrel (24). (FIGS. 2 and 10).

Figures 10, 10A, 10B:
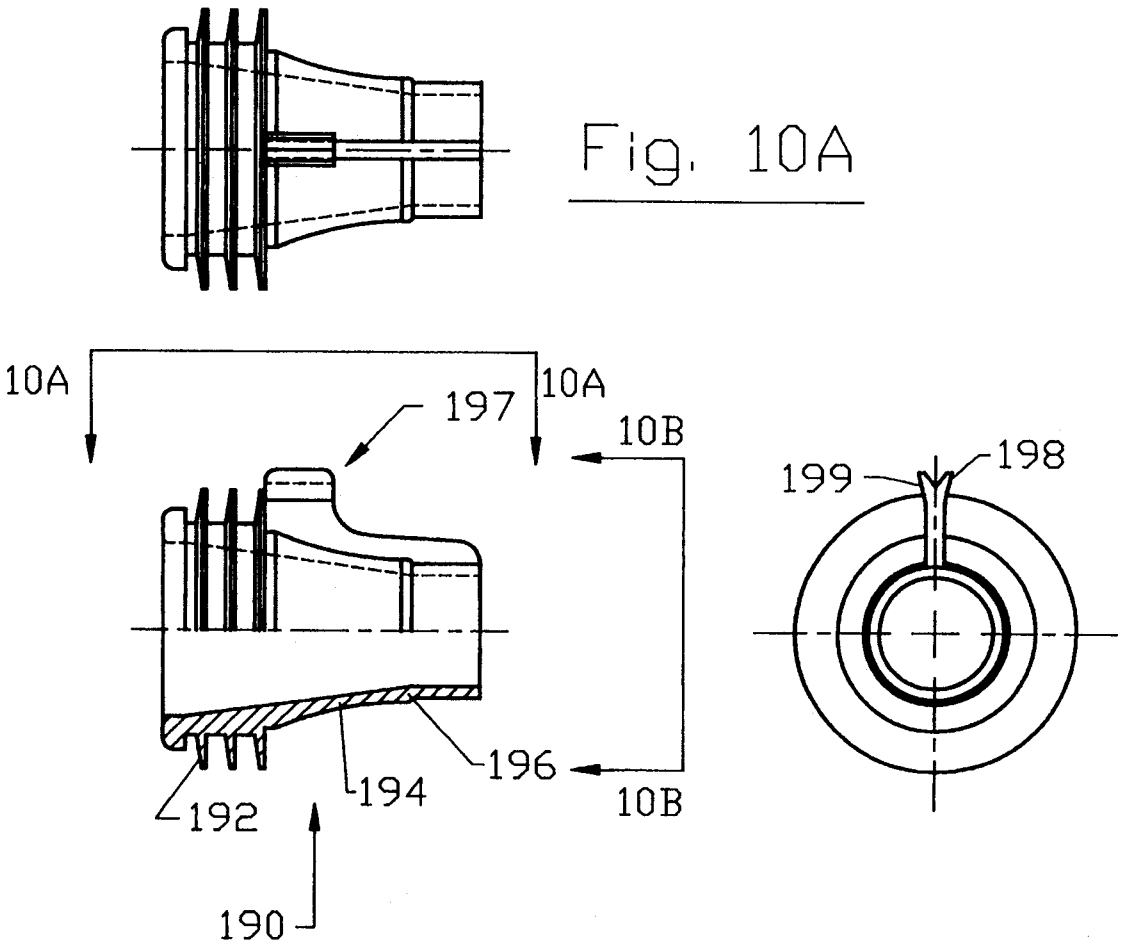
FIG. 10 is a side elevation view partly in section of the outermost cooling assembly of the present invention also including a sight in accordance with the present invention.
FIG. 10A is a top view of FIG. 10 in accordance with the present invention.
FIG. 10B is an end view of FIG. 10 in accordance with the present invention.

A projection (197) is formed in cooling assembly (190) and contoured as indicated in FIG. 10B having opposed sides (198, 199) to form a sight. (FIG. 10).

In operation to install the flint, the knob (114) is rotated to remove the knob (114), spring (146), and the flint pusher (140). The flint (150) is then placed upon the piston rod portion (67). Then the spring (146) is reinserted located between the flint pusher (140) and the flint knob (114). The flint knob is rotated to provide suitable pressure to maintain the flint in engagement in the rod portion (67). As the flint (150) is worn, pressure may be maintained by further rotation of knob (114). (FIGS. 5 and 7).

Figure 8A:
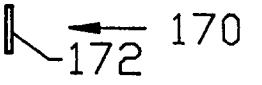
FIG. 8A is a view looking in the direction of the arrows along the line 8A—8A in FIG. 8.
Figure 8:
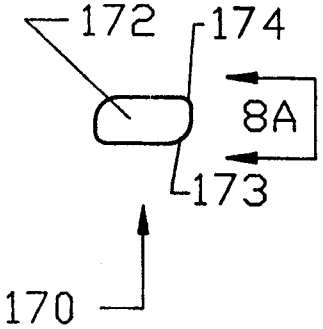
FIG. 8 is a view of the transparent lenses utilized in the flint opening in the present invention.

In order to operate, grasp the handle portion (22), insert finger through opening (30), pull upon the trigger member (40) causing it to pivot about the pin (46), move the pin (52) along the slot (36), moving link (50) from left to right sufficient to move the slot (58) and the downward extension (69) from left to right in FIG. 2. This movement of rod (60) is opposite to the bias of spring (80) and also opposite to the bias spring (102). This movement of piston rod (60) occurs with respect to fixed cylinder (70). This movement continues until the trigger (40) forces the link (50) sufficiently far to the right that the projection (69) is moved out of the slot (58). When this occurs, the piston rod (60) then under the bias of the spring (80) moves rod (60) from right to left very rapidly. During right to left movement of the piston red (60) the stationary flint (150) engages the cut and/or roughened portion (67) of the piston red and causes a spark to occur. This spark is viewable through the translucent members (172) in the viewing assembly (160). (FIGS. 2 & 8).

The right to left movement of rod (60) causes air compressed within the cylinder (70) to escape from the cylinder (70), and piston head (72) abuts piston head (96), causing a "pop". (FIG. 2).

The action of the piston (60) is cushioned by the spring assembly (90) when the head (96) engages the piston head (63). This depresses the spring (91) which acts as a cushion for the piston (60). (FIG. 2).

Spring (100) causes trigger (40) and link (50) to return to their original position. When this occurs projection (69) again engages the slot (58) in link (50) to allow repeating of this procedure. (FIG. 2).

The cooling fin assemblies (180, 190) do not function significantly to cool the assembly because there is not sufficient real heat generated in this pistol. These assemblies are primarily provided for decoration and simulation of actual pistol firing.

The use of the "lost wax" or investment casting process to form the housing halves (12, 12') of the pistol allows the construction of an attractive classical, outer finish of the pistol depending on alloy composition. The use of counter sunk screws (16, 17, 18) provides an attractive and effective method of holding the assembly together. The use of the pistol halves (12, 12') to form the guiding assembly for the action of piston rod (60) including the slot (36, 36') and the surfaces (27, 29) of the body portion represents a significant improvement over the construction shown in U.S. Pat. No. 2,077,763, since the expensive guiding element has been eliminated in accordance with the present invention. (FIGS. 2 and 3).

What is claimed is:

1. A Collector's Model Disintegrator pistol comprising:

investment cast left and right pistolhalf sections each half defining a portion of:

a pistol handle portion comprising a downwardly extending, generally cylindrical, hollow portion and a handle external surface;

a pistol body portion having a cast trigger opening and a head portion located at the top of the body portion containing at least one spark observance opening;

a barrel portion having a circular cross section extending outwardly from said body portion housing a cylinder adjacent an abutment and a piston rod having a piston head extending within said cylinder said piston head in facing arrangement with a pop piston, the pop piston in said barrel portion and spring biased into said cylinder while being adapted to exit said cylinder when propelled by air pushed by said piston head;

said piston rod extending within a barrel resilient means located within said barrel; said piston rod having a generally horizontal portion located within said body portion adjacent said head portion; said piston rod having a distal end portion extending into said pistol body portion;

a trigger member mounted within said body portion near said head portion and having a trigger distal end extending downward into the said trigger opening;

a link member within said body portion having a cam slot adjacent its distal end and being pivotally mounted upon a transversely extending pin within said body portion and extending through said trigger;

said pin extending into spaced apart arcuate cast slots located respectively within each of said cast halves;

said piston rod horizontal portion including a roughened surface;

said piston rod distal end portion including a vertical projection extending into said cam slot;

spring means releasably biasing a flint member within said head portion into engagement with said roughened surfaces; whereby when said trigger member is actuated by an operator pulling said trigger rearwardly, said trigger member pivots around its upper end, said link drives said piston rod to move in a rearward direction against the bias of said barrel resilient means, within said body portion and guided solely by said body portion, said flint member and said link member until such time as said piston rod vertical projection is moved out of said cam slot, whereby said piston rod moves rapidly in a forward direction, guided solely by said body portion and said flint member, under the bias of said barrel resilient means, whereby said roughened portion engages said flint member, causing a spark visible in said spark opening, and whereby said piston head is moved within said cylinder, forcing air within said cylinder until said piston head pushes air against said pop piston to force said pop piston to exit said cylinder, with an audible pop firing sound and whereby said audible pop firing sound and said spark are both activated by said piston rod.

2. A pistol according to claim 1 wherein a trigger resilient means located within said body portion engages said link member and said trigger and biases said link and said trigger into a forward position within said body portion.

3. A pistol according to claim 1 wherein gripping projections are investment cast into the external surface of said handle portion.

4. A pistol according to claim 1 wherein the cross section of said barrel is dimensioned so as to receive said barrel resilient means upon a first shoulder within said barrel, and wherein said barrel is further dimensioned to receive said cylinder in an outer position within said barrel relative to said barrel resilient means.

5. A pistol according to claim 4 wherein said barrel is further dimensioned as to define a housing for said second resilient means located outboard of said cylinder within said barrel.

6. A pistol according to claim 1 wherein removable resilient means are provided for biasing said flint into engagement with said roughened portion of said piston rod.

7. A pistol according to claim 6 wherein knob means are provided for applying biasing force upon said flint as said flint is worn down during operation.

8. A pistol according to claim 1 wherein said transparent material is placed within said spark opening whereby said spark ignition may be observed outside of said pistol.

9. A pistol according to claim 8 wherein a plurality of openings are provided in said head portion and wherein each of said openings is provided with transparent material whereby said spark may be more readily observed.

10. A pistol according to claim 1 wherein at least one cooling fin assembly is provided, located upon said barrel including at least one cooling fin extending outward from said barrel.

11. A pistol according to claim 10 wherein a plurality of cooling fins assemblies are provided on said barrel, one cooling fin assembly located generally adjacent to said body portion and the other cooling fin assembly located near the distal end of said barrel.

12. A pistol according to claim 11 wherein each of said cooling fin assemblies includes a plurality of outward extending tapered fin members, and wherein each of said fin members integrally engages a fin body portion which engages said barrel.

13. A pistol according to claim 1 wherein means for sighting are provided on said pistol.

14. A pistol according to claim 11 wherein the means for sighting are provided on at least one of said cooling fin assemblies.

15. A cooling fin assembly according to claim 14 wherein the means for sighting comprise a vertically extending member having a pair of diverging legs which are generally V-shaped, defining a sight above said barrel.

16. A pistol according to claim 7 wherein the means for applying biasing force upon said flint in engagement with said piston rod comprises a flint housing mounted within said head portion including a housing body portion at least partially engaging the walls of said head portion and having an upward extending threaded portion and a flint downward extension hollow portion; said knob means including an outward extending knurled portion for gripping and generally cylindrically shaped threaded portion engaging the threaded portion of said flint housing, said flint knob further having a depending portion of reduced cross-section located outward of said knob threaded portion and extending within said flint housing.

17. A pistol according to claim 16 wherein said flint housing assembly includes flint biasing means located between said knob means and said flint member.

18. A pistol according to claim 17 wherein said flint member comprises a flint pusher which in turn engages said flint biasing means.

19. A pistol according to claim 18 wherein said flint biasing means engages said flint pusher and said flint housing.

* * * * *